United States Patent [19]

Parker et al.

[11] 4,242,100

[45] Dec. 30, 1980

[54] MOTOR FUEL COMPOSITION

[75] Inventors: Donnie G. Parker, Bartlett; James D. Milligan, Memphis, both of Tenn.

[73] Assignee: Tri-Pak, Inc., Memphis, Tenn.

[21] Appl. No.: 84,568

[22] Filed: Oct. 15, 1979

[51] Int. Cl.[3] ..... C10L 1/18; C10L 1/20

[52] U.S. Cl. ..... 44/53; 44/56; 44/79

[58] Field of Search ..... 44/53, 56, 79

[56] References Cited

U.S. PATENT DOCUMENTS

| | | | |
|---|---|---|---|
| 1,313,158 | 8/1919 | Backhaus | 44/79 |
| 1,815,753 | 7/1931 | Wilson | 44/79 |
| 3,902,868 | 9/1975 | Zoch, Jr. | 44/56 |

*Primary Examiner*—Jacqueline V. Howard

*Attorney, Agent, or Firm*—Dressler, Goldsmith, Shore, Sutker & Milnamow, Ltd.

[57] ABSTRACT

A motor fuel composition is prepared containing methanol, alkyl-substituted benzene, heptane and chlorinated benzene. The composition may be used as a motor fuel, or may be blended with a conventional gasoline as an extender and/or to increase the octane number of the latter.

6 Claims, No Drawings

MOTOR FUEL COMPOSITION

DESCRIPTION

Technical Field

This invention relates to motor fuels and particularly to compositions which are useful as motor fuels of high octane value, or as additives to conventional gasoline fuels to increase their octane values.

Background Art

Resistance of a fuel, such as gasoline, to pre-ignition detonation is conventionally measured by standardized laboratory engine tests. The Research Method (ASTM Method D-908, Coordinating Research Council Designation F-1-545) measures the octane number of a fuel under low speed conditions; and references herein to "octane number," or "octane value" refer to values obtained in this test.

Conventional gasoline fuels vary in their natural (without additives) octane (or antiknock) values depending on the nature of the petroleum crudes from which they are prepared and the processing to which the crudes are subjected. Gasoline fuels of low natural octane values are less costly than fuels of higher natural octane values and can be made in higher yields from the same amount of petroleum crude.

To obtain adequate engine performance from gasoline fuels of low natural octane values, it is customary to blend them with additives which increase their octane values. Tetraethyl lead is a particularly effective additive for increasing the octane value of gasoline fuels, providing increased octane values at much lower additive levels than other materials.

Tetraethyl lead, however, produces lead-containing emissions which are harmful to the environment and its use as a gasoline additive is being phased out. It is essential that other antiknock fuels and other antiknock additives be found that can be used in motor vehicles without requiring carburetion adjustment.

It is known that methanol, added to gasoline, increases its octane value. Its low cost and potential abundance are also attractive. However, methanol has only limited solubility in gasoline fuel fractions and only small amounts of methanol can be added to gasoline when methanol is the sole antiknock additive.

Aromatic compounds, and particularly lower alkyl-substituted benzenes, such as toluene and the xylenes, are known to increase the solubility of methanol in gasoline and have the added benefit of being, themselves, useful to increase the octane number of gasoline.

DISCLOSURE OF INVENTION

In accordance with the present invention a motor fuel composition is provided which comprises about 50 to about 70 parts by weight of methanol, about 10 to about 30 parts by weight of at least one alkyl-substituted benzene having 7 to 10 carbon atoms, about 0 to about 30 parts by weight of normal heptane, and about 2 to about 10 parts by weight of a chlorinated benzene.

The composition may be used as a motor fuel by itself, or it may be blended with conventional gasoline fractions in proportions usually in the range of about 25:75 to about 75:25 by weight as an extender for the gasoline fraction and/or to enhance the octane number of the gasoline fraction. In either case, an internal combustion engine can operate with such a fuel without changing its normal carburetion settings.

The compositions of this invention are fuels of exceptionally high octane number, well over 100. They are also capable of raising the octane numbers of relatively low octane gasolines to values about 100 when blended therewith. This is surprising in view of the content of normal heptane, which in the preferred compositions is about 10 to about 20 parts by weight, since normal heptane has a zero octane number by the octane number definition.

The alkyl-substituted benzene may, for example, be toluene, any of the xylenes (or a mixture of xylenes), ethyl benzene, any of the trimethyl benzenes, cumene, p-cymene, or mixture of these compounds. The preferred alkyl-substituted benzene component is a mixture of toluene and xylene (mixed xylenes). In the total composition, the preferred range for toluene is from about 5 to about 15 parts by weight and the preferred range for xylene is the same. Most preferably the toluene and xylenes are present in about equal weights.

The preferred amount of methanol in the composition is from about 55 to about 65 parts by weight.

The chlorinated benzene can be mono- or polychlorinated, e.g., chlorobenzene, the o-, m-, and p-dichlorobenzenes, and the like. Preferred is orthodichlorobenzene, and a preferable weight range for this constituent is about 3 to about 7 parts by weight. It is believed that the chlorinated benzene acts as a solubilizer to extend the solubility range of methanol in the alkyl benzene or heptane-alkyl benzene system so that the fuel composition remains as a single phase with methanol contents higher than those which could be tolerated without the chlorinated benzene component.

If desired, and particularly for winter use in cold climates, a small amount (from a trace to about 5 weight percent) of a butane fraction may be added to the composition. The butane may be added by bubbling butane vapor through a mixture of the other components of the composition.

Best Mode for Carrying Out the Invention

A fuel composition was prepared by blending:

methanol—55 parts by weight
xylene (mixed xylenes)—10 parts by weight
toluene—10 parts by weight
n-heptane—20 parts by weight
o-dichlorobenzene—5 parts by weight Butane was bubbled through the mixture to dissolve therein a small amount (less than about 1 part by weight) of butane.

The mixture had a vapor pressure of 4.9 pounds per square inch at 100° F. and an API gravity of 44.4 at 60° F. It contained no free sulfur and no mercaptan sulfur and had a corrosion rating 1A, equivalent to no corrosion.

The octane rating of the above composition was 110.0. When blended at a 50—50 weight ratio with a commercial gasoline having an octane number of 91.9, the blend had an octane rating of 101.7. All antiknock tests were by the Research method.

The distillation curve of the above composition (without gasoline) was essentially flat over a substantial portion of the distillation test, the results being as follows:

| Distillation Test | 99% Recovery<br>0.5% Residue<br>0.5% Loss |
|---|---|
| Initial Flash | 138° F. |
| 5% | 140° F. |
| 10% | 142° F. |
| 20% | 142° F. |
| 30% | 142° F. |
| 40% | 144° F. |
| 50% | 146° F. |
| 60% | 146° F. |
| 70% | 148° F. |
| 80% | 150° F. |
| 90% | 150° F. |
| 95% | 256° F. |
| End Point | 342° F. |

Another typical composition can comprise:
methanol—65 parts by weight
xylene(mixed xylenes)10 parts by weight
toluene—10 parts by weight
n-heptane—10 parts by weight
o-dichlorobenzene—5 parts by weight
butane—5 parts by weight While the invention has been described with respect to its preferred embodiments, it will be understood by those skilled in the art that modifications and variations may be made without departing from the invention as defined in the appended claims.

What is claimed is:

1. A fuel composition comprising about 50 to about 70 parts by weight of methanol, about 10 to about 30 parts by weight of at least one alkyl-substituted benzene having from 7 to 10 carbon atoms, about 0 to about 30 parts by weight of normal heptane, and about 2 to about 10 parts by weight of a chlorinated benzene.

2. The composition of claim 1 wherein said methanol is present in an amount of about 55 to about 65 parts by weight, said alkyl-substituted benzenes comprise toluene in an amount of about 5 to about 15 parts by weight and at least one xylene, the amount of xylene comprising about 5 to about 15 parts by weight, said heptane is present in an amount of about 10 to about 20 parts by weight and said chlorinated benzene is orthodichlorobenzene and is present in a amount of about 3 to about 7 parts by weight.

3. The composition of claim 1 comprising:
methanol—about 55 parts by weight
xylene—about 10 parts by weight
toluene—about 10 parts by weight
n-heptane—about 20 parts by weight
o-dichlorobenzene—about 5 parts by weight.

4. The composition of claim 1 containing in addition butane in an amount of a trace to about 5 parts by weight.

5. A motor fuel composition comprising from about 25 to about 75 weight percent of a gasoline fraction and about 75 to about 25 weight percent of the composition of claim 1.

6. The motor fuel composition in accordance with claim 5 and comprising about 50 weight percent of a gasoline fraction and about 50 weight percent of the composition of claim 3.

* * * * *